US005291624A

United States Patent [19]

Strobel

[11] Patent Number: 5,291,624

[45] Date of Patent: Mar. 8, 1994

[54] FRAME FOR WATERBED

[76] Inventor: Mark J. Strobel, 3131 Industrial Pkwy., Jeffersonville, Ind. 47130

[21] Appl. No.: 27,195

[22] Filed: Mar. 5, 1993

Related U.S. Application Data

[63] Continuation-in-part of Ser. No. 898,683, Jun. 15, 1992, Pat. No. 5,231,715.

[51] Int. Cl.[5] ..... A47C 19/00

[52] U.S. Cl. ..... 5/400; 5/451; 5/917

[58] Field of Search ..... 5/451, 400, 452, 450, 5/917, 401, 449

[56] References Cited

U.S. PATENT DOCUMENTS

| | | | |
|---|---|---|---|
| 3,735,432 | 5/1973 | Kreten et al. | 5/451 |
| 3,838,470 | 10/1974 | May | 5/451 |
| 4,625,351 | 12/1986 | Campian | 5/451 |
| 4,713,852 | 12/1987 | Fox, Sr. et al. | 5/451 |
| 4,879,775 | 11/1989 | Keefer | 5/451 |
| 4,901,383 | 2/1990 | Yang et al. | 5/400 |
| 5,231,716 | 8/1993 | Somenning | 5/451 |

*Primary Examiner*—Alexander Grosz
*Attorney, Agent, or Firm*—James B. Middleton

[57] ABSTRACT

A frame for a waterbed has a lower portion of each rail formed of wood or other generally rigid material, and an upper portion formed of foamed plastic or other padding material. The lower portion provides the strength to withstand the outward forces of the water mattress, while the padding of the upper portion provides comfort for sleeping or sitting on the edge of the bed. The bottom of the rails have a flange fixed thereto. The lower portions of the rails, at their ends, have alignment devices to align the rails, and clamps fixed to the flanges fix rails together so the rails are easy to assemble into a complete frame.

8 Claims, 1 Drawing Sheet

FRAME FOR WATERBED

CROSS-REFERENCE TO RELATED APPLICATION

This application is a continuation-in-part of the copending application by the same inventor, Ser. No. 898,683, filed Jun. 15, 1992, now U.S. Pat. No. 5,231,715 entitled "Side Rail Construction For Water Bed".

BACKGROUND OF THE INVENTION

1. Field of the Invention

This invention relates generally to frames for waterbeds, and is more particularly concerned with a frame for a conventional waterbed having soft upper edges of the rails, and being easily assemblable by the consumer.

2. Discussion of the Prior Art

There have been numerous water bed frames devised in the past, these waterbed frames comprising two general categories: the "hard side" full flotation waterbed frames; and, the "soft side" waterbeds having a smaller fill height. The "hard side" frames have been favored as providing complete flotation for the human body. The drawback, however, is that one must generally sleep within a rigid frame, the rigid frame being required to hold the volume of water contained within such a mattress. These hard sides can be unpleasant when a person inadvertently rolls over too far while sleeping so that he engages the frame of the waterbed. Also, the frames can be somewhat unpleasant if a person sits on the edge of the bed.

The prior art solution to the discomfort of the hard sides of a full flotation waterbed have included rail caps or the like which comprise simply padding on the upper edges of the rails. While such padding provides a relatively soft seat, and may reduce the unpleasantness of rolling over against the rails, such efforts to solve the problem do not achieve the comfort of the soft sided waterbed.

Another long standing problem with conventional waterbeds is that the consumer usually assembles the waterbed frame. Even though all pieces may be precut appropriately, one is required to assemble the frame members, and usually to attach the frame members to the deck. The attachment to the deck is both to prevent bowing of the side rails, and to assist in holding the waterbed frame on the deck. When any of these steps is poorly performed, as they might be by the ordinary consumer, one is likely to have bowing of the bed frames, and perhaps slippage of the frame from the appropriate, centered position on the deck.

SUMMARY OF THE INVENTION

The present invention provides a waterbed frame for a full flotation waterbed, the frame having its upper extremity made of a foam or other cushioning or padding material. The lower portions of the rails are made of wood or the like, and only the upper edge is made of cushioning material; therefore, the rail retains sufficient strength at the bottom of the rail, which receives the greatest force from the water contained in the bed, while the upper edge of the rail is comfortable for either sleeping or sitting.

For additional strength of the rails, there is a wide flange fixed to the bottom edge of the rails. Again, the greatest force tending to bow the rails is at the bottom of the frame, so the reinforcing flange is appropriately placed to prevent bowing of the rails.

It is contemplated that the rail of the present invention will be assembled by the factory, but the consumer, or the retail seller, will assemble four rails to create a complete bed frame. In accordance with the present invention, there are alignment members for easy alignment of adjacent rails, and for stability in retaining the alignment. The alignment means in conjunction with a quick clamp provides for full assembly of the waterbed frame without the use of tools, and yet provides a rigid waterbed frame.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
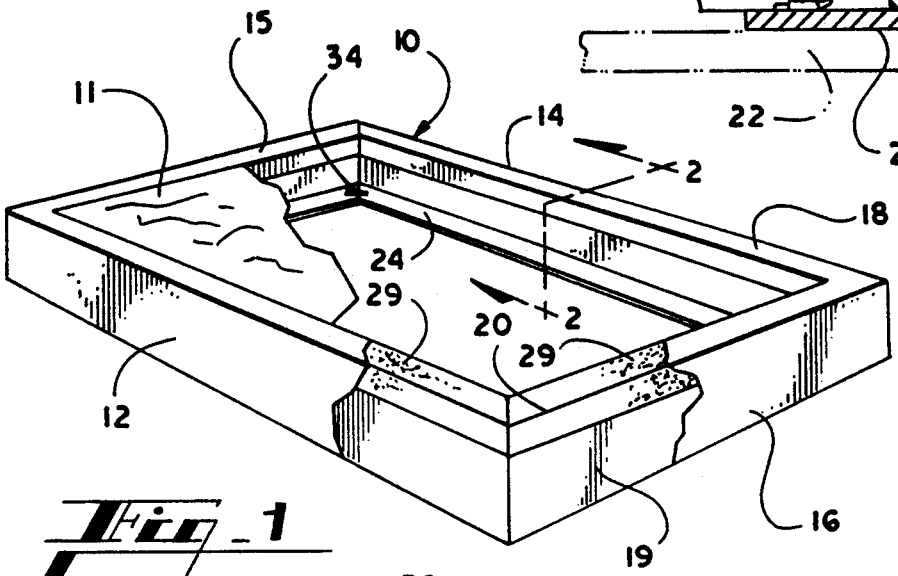
FIG. 1 is a perspective view of a bed frame made in accordance with the present invention, portions of the covering being broken away to show the construction, and showing a portion of a waterbed mattress.

Referring now more particularly to the drawings, and to that embodiment of the invention here presented by way of illustration, FIG. 1 shows a waterbed frame generally designated at 10 and having a portion of a waterbed mattress 11 contained within the frame 10. The frame 10 comprises four rails, including two side rails 12 and 14, and head and foot rails 15 and 16. Each of the rails 12, 14, 15 and 16 is constructed the same, so only one rail will be described in detail. Similarly, each of the four corners where two rails are joined are formed the same, so only one corner will be described in detail.

As will be discussed in more detail hereinafter, each of the rails has a covering 18 thereover for an attractive appearance of the frame 10. In FIG. 1, looking at the rails 12 and 16, it will be seen that the covering 18 has been partially broken away to show the rails themselves. The lower portion of the rails is designated at 19 and is formed of wood or other material with sufficient strength to retain the water. The upper portion 20 of the rail 16 is formed of foam or other padding material.

Figure 2:
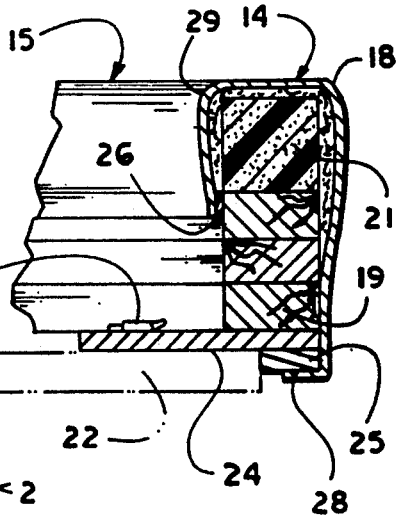
FIG. 2 is an enlarged cross-sectional view taken substantially along the line 2—2 in FIG. 1; and, FIG. 3 is an enlarged, fragmentary top plan view showing one corner of the waterbed frame illustrated in FIG. 1, portions being broken away to show the details of construction.

FIG. 2 illustrates the construction of the rails in more detail, and it can be seen that the lower portion 19 of the rail 14 is formed of three pieces of wood stacked on top of each other to achieve the desired height. It will be obvious to those skilled in the art that a single piece of wood can be used, though superior strength is obtained by having the three pieces lying on their sides so that the width of the wood counteracts the force of the water within the mattress 11.

On top of the lower portion 19, there is a generally square padding member 21. It should be understood that the padding member 21 has substantially the same width as the wooden, lower portion 19, and has sufficient height to complete the desired height of the waterbed frame. Thus, from the upper surface of the foam padding member 21 to the deck indicated at 22, the frame will be, for example, 11 inches high.

Below the lower portion 19, there is a flange 24 which is fixed to the lower portion 19. This flange 24 is also shown in FIG. 1 of the drawings where it will be seen that the flange 24 extends the full length of the rail 14. As here shown, there is a bumper strip 25 fixed to the bottom of the flange 24, the bumper strip 25 preferably being located to engage the edge of the deck 22. With such an arrangement it will be understood that the bed frame 10 will be prevented from moving relative to the deck 22 because there will be a bumper strip 25 on each of the four edges of the deck 22. While this is a convenient arrangement, it will also be readily understood that the strip 25 can be omitted, and the flange 24 can be fixed to the deck 22, or other conventional means may be utilized.

Both to improve the appearance of the frame 10, and to assist in securing the member 21 to the upper surface of the member 19, there is the covering 18. The covering 18 may be formed of sheet vinyl or other flexible sheet material as desired, and one edge is secured to the member 19 as at 26. The material is then extended up to the top of the rail 14, across the rail, and down to the bottom of the rail 14 to be secured as at 28. It will of course be understood that the foam member 21 will be adhesively secured to the member 19, but the covering 18 will then be pulled taut to assist in holding the foam member 21 to the wooden lower portion 19. It will also be noted that, as here shown, there is additional padding, indicated as fibrous material, 29 between the covering 18 and the foam member 21. While such additional padding material is optional, additional comfort may be secured by the padding 29.

As is mentioned above, each of the four rails 12, 14, 15 and 16 will be the same, so the above description, and the construction shown in FIG. 2, will be the same for all of the four rails and no further description is thought to be necessary.

Figure 3:
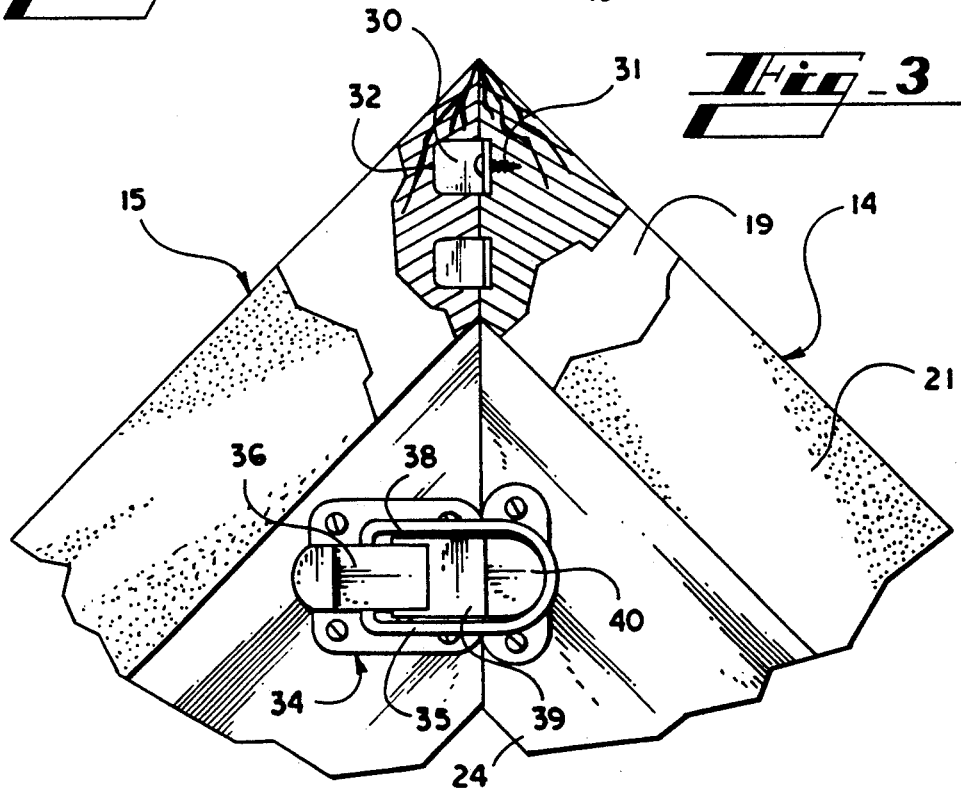

Looking now at FIG. 3 of the drawings, it will be seen that the ends of the rails are formed at a 45° angle so assembly of two rails will create the desired square corners of the frame 10. In FIG. 3, the side rail 14 and head rail 15 are illustrated. The covering 18 is omitted, and portions of the rails have been broken away to show the construction of the corner.

First, it will be seen that the junction of the lower portions 19 includes generally a mortise and tenon arrangement. The tenons indicated at 30 are here indicated as separate members made of metal or the like and fixed to the wood of the lower portion 19, for example by wood screws 31. These tenons 30 are then received into appropriate mortises 32 in the lower portion 19 of the rail 15.

Those skilled in the art will understand that the ends of the rails 14 and 15 will be rather accurately cut at 45°, so the ends of the rails will fit together properly. Then, with the mortises and tenons 32 and 30, the rails can easily be accurately aligned, and the mortises and tenons will serve to maintain the alignment.

To hold the two rails 14 and 15 together, there is a clamp of a well known variety illustrated in FIG. 3. Again, those skilled in the art will understand that many different forms of clamps may be utilized to hold the two rails together, but the toggle clamp here illustrated is readily available and works quite well. Briefly, the clamp 34 includes a loop 35 pivoted to a lever 36, the lever 36 being pivoted at 38 to the body 39. A keeper 40 selectively receives one end of the loop 35. In operation, therefore, the lever 36 can be lifted, towards the viewer in the drawings, and the loop 35 will become loose on the keeper 40, so the loop 35 can be removed from the keeper, and the two rails can be separated. When the two rails are to be fixed together, the lever 36 will be raised, and the loop 35 placed over the keeper 40. The lever 36 will then be pushed down towards the paper, and the loop 35 will be pulled snugly against the keeper 40. The loop 35 and the lever 36 are arranged as a toggle so the clamp will not inadvertently come loose. This clamp 34 is well known in the art and no further description should be necessary.

It will therefore be seen that the present invention provides a very simple frame for a water bed, the frame having sufficient depth for a full flotation mattress 11 therein, while the upper edge of the frame is relatively soft for comfort in sleeping against the rail or sitting on the rail. The rail is reinforced against bowing, even after extended use, in view of the construction of the portion 19, plus the bottom flange 24. Even with this durable construction, the frame can be shipped knocked-down, for assembly by the consumer. Two rails are simply placed together at their ends, and the mortises and tenons provide easy alignment, and the clamp 34 provides firm holding of adjacent rails.

It will of course be understood by those skilled in the art that the particular embodiments of the invention here presented are by the way of illustration only, and are meant to be in no way restrictive; therefore, numerous changes and modifications may be made, and the full use of equivalents resorted to, without departing from the spirit or scope of the invention as outlined in the appended claims.

I claim:

1. A frame for a waterbed comprising a plurality of rails, said plurality of rails including a pair of side rails and connecting head and foot rails for containing a water mattress, each rail of said plurality of rails having a lower portion and an upper portion, said lower portion being formed of generally rigid material for counteracting the outward force of said water mattress, said upper portion being fixed to said lower portion and consisting of padding material, said padding material extending from said lower portion to the upper surface of said water mattress, and means connecting said lower portions of said side rails to said head rail and foot rail, said padding material including a foamed member, and further including a cover for each rail of said plurality of rails, said cover being fixed to said lower portion, extending over said padding material, and extending to the bottom of said lower portion, said lower portion comprising a plurality of wooden members fixed together, each rail of said plurality of rails further including a flange fixed to the bottom of said lower portion, said means connecting said lower portions of said side rails including clamps fixed to said flanges.

2. A frame for a waterbed as claimed in claim 1, and further including alignment means for aligning said lower portions of said side rails.

3. A frame for a waterbed as claimed in claim 2, said alignment means comprising tenons carried by some of said rails, and mortises defined in adjoining rails.

4. A frame for a waterbed comprising a plurality of rails, said plurality of rails including a pair of side rails and connecting head and foot rails for containing a water mattress, each rail of said plurality of rails including a flange fixed to the bottom of said rail, alignment means carried by said rails, and clamp means carried by said flanges so that said alignment means align adjacent rails and said clamp means secure adjacent rails together.

5. A frame for a waterbed as claimed in claim 4, said alignment means including a tenon carried by one rail, and a mortise defined in an adjacent rail.

6. A frame for a waterbed as claimed in claim 5, said clamp means including a toggle clamp for securing one flange to an adjacent flange.

7. A frame for waterbed as claimed in claim 6, each rail of said plurality of rails including a lower portion and an upper portion, said upper portion consisting of a padded member.

8. A frame for waterbed as claimed in claim 7, and further including a cover extending over said padded member.

* * * * *